US010446903B2

(12) United States Patent
Black et al.

(10) Patent No.: US 10,446,903 B2
(45) Date of Patent: Oct. 15, 2019

(54) CURVED SURFACE SCATTERING ANTENNAS

(71) Applicant: Searete LLC, Bellevue, WA (US)

(72) Inventors: Eric J. Black, Bothell, WA (US); Pai-Yen Chen, Houston, TX (US); Brian Mark Deutsch, Snoqualmie, WA (US); Tom Driscoll, San Diego, CA (US); Siamak Ebadi, Bellevue, WA (US); John Desmond Hunt, Knoxville, TN (US); Alexander Remley Katko, Bellevue, WA (US); Nathan Ingle Landy, Mercer Island, WA (US); Melroy Machado, Seattle, WA (US); Milton Perque, Jr., Seattle, WA (US); David R. Smith, Durham, NC (US); Yaroslav A. Urzhumov, Bellevue, WA (US)

(73) Assignee: The Invention Science Fund I, LLC, Bellevue, WA (US)

( * ) Notice: Subject to any disclaimer, the term of this patent is extended or adjusted under 35 U.S.C. 154(b) by 584 days.

(21) Appl. No.: 14/711,569

(22) Filed: May 13, 2015

(65) Prior Publication Data

US 2015/0318620 A1 Nov. 5, 2015

Related U.S. Application Data

(63) Continuation-in-part of application No. 14/506,432, filed on Oct. 3, 2014, now Pat. No. 9,853,361, and a (Continued)

(51) Int. Cl.

*H01Q 11/04* (2006.01)
*H01Q 1/12* (2006.01)

(Continued)

(52) U.S. Cl.

CPC ..... *H01Q 1/12* (2013.01); *H01Q 1/1264* (2013.01); *H01Q 1/38* (2013.01); *H01Q 11/04* (2013.01);

(Continued)

(58) Field of Classification Search

CPC ..... H01Q 1/12; H01Q 1/1264; H01Q 1/38; H01Q 11/04; H01Q 21/00; H01Q 21/0087;

(Continued)

(56) References Cited

U.S. PATENT DOCUMENTS 3,001,193 A 9/1961 Marie
3,388,396 A 6/1968 Rope et al.

(Continued)

FOREIGN PATENT DOCUMENTS

CN 103222109 A 7/2013
JP 52-13751 A 2/1977

(Continued)

OTHER PUBLICATIONS

Ayob et al. "A Survey of Surface Mount Device Placement Machine Optimisation: Machine Classification", Computer Science Technical Report No. NOTTCS-TR-2005-8, Sep. 2005.*

(Continued)

*Primary Examiner* — Hai V Tran
*Assistant Examiner* — Bamidele A Jegede

(57) ABSTRACT

Surface scattering antennas on curved manifolds provide adjustable radiation fields by adjustably coupling scattering elements along a wave-propagating structure.

20 Claims, 7 Drawing Sheets

Related U.S. Application Data continuation-in-part of application No. 14/549,928, filed on Nov. 21, 2014, now Pat. No. 9,711,852.

(60) Provisional application No. 61/992,699, filed on May 13, 2014, provisional application No. 61/988,023, filed on May 2, 2014, provisional application No. 62/015,293, filed on Jun. 20, 2014.

(51) Int. Cl.
*H01Q 21/00* (2006.01)
*H01Q 1/38* (2006.01)

(52) U.S. Cl.
CPC ..... *H01Q 21/00* (2013.01); *H01Q 21/0087* (2013.01); *Y10T 29/49018* (2015.01)

(58) Field of Classification Search
CPC .. Y10T 29/49018; H05K 3/425; H05K 1/147; H05K 2203/024
USPC ..... 343/772
See application file for complete search history.

(56) References Cited

U.S. PATENT DOCUMENTS 3,604,012 A * 9/1971 Lindley ..... H01Q 3/38 342/371
3,714,608 A 1/1973 Barnes et al.
3,757,332 A 9/1973 Tricoles
3,887,923 A 6/1975 Hendrix
4,150,382 A 4/1979 King
4,195,262 A 3/1980 King
4,229,745 A 10/1980 Kruger
4,291,312 A 9/1981 Kaloi
4,305,153 A 12/1981 King
4,489,325 A 12/1984 Bauck et al.
4,509,209 A 4/1985 Itoh et al.
4,672,378 A 6/1987 Drabowitch et al.
4,701,762 A 10/1987 Apostolos
4,780,724 A 10/1988 Sharma et al.
4,832,429 A 5/1989 Nagler
4,874,461 A 10/1989 Sato et al.
4,920,350 A 4/1990 McGuire et al.
4,947,176 A 8/1990 Inatsune et al.
4,978,934 A 12/1990 Saad
5,043,738 A 8/1991 Shapiro et al.
5,198,827 A 3/1993 Seaton
5,455,590 A 10/1995 Collins et al.
5,512,906 A 4/1996 Speciale
5,734,347 A 3/1998 McEligot
5,841,543 A 11/1998 Guldi et al.
5,889,599 A 3/1999 Takemori
6,031,506 A 2/2000 Cooley et al.
6,061,023 A 5/2000 Daniel et al.
6,061,025 A 5/2000 Jackson et al.
6,075,483 A 6/2000 Gross
6,084,540 A 7/2000 Yu
6,114,834 A 9/2000 Parise
6,166,690 A 12/2000 Lin et al.
6,198,453 B1 * 3/2001 Chew ..... H01Q 13/10 343/767
6,211,823 B1 4/2001 Herring
6,232,931 B1 5/2001 Hart
6,236,375 B1 5/2001 Chandler et al.
6,275,181 B1 8/2001 Kitayoshi
6,313,803 B1 * 11/2001 Manasson ..... H01Q 3/46 343/756
6,366,254 B1 4/2002 Sievenpiper et al.
6,384,797 B1 5/2002 Schaffner et al.
6,396,440 B1 5/2002 Chen
6,469,672 B1 10/2002 Marti-Canales et al.
6,545,645 B1 4/2003 Wu
6,552,696 B1 4/2003 Sievenpiper et al.
6,633,026 B2 10/2003 Tuominen
6,636,179 B1 10/2003 Woo et al.
6,985,107 B2 1/2006 Anson et al.
7,068,234 B2 6/2006 Sievenpiper
7,151,499 B2 12/2006 Avakian et al.
7,154,451 B1 12/2006 Sievenpiper
7,162,250 B2 1/2007 Misra
7,253,780 B2 8/2007 Sievenpiper
7,295,146 B2 11/2007 McMakin et al.
7,307,596 B1 12/2007 West
7,339,521 B2 3/2008 Scheidemann et al.
7,428,230 B2 9/2008 Park
7,456,787 B2 11/2008 Manasson et al.
7,609,223 B2 10/2009 Manasson et al.
7,667,660 B2 2/2010 Manasson et al.
7,830,310 B1 11/2010 Sievenpiper et al.
7,834,795 B1 11/2010 Dudgeon et al.
7,864,112 B2 1/2011 Manasson et al.
7,911,407 B1 3/2011 Fong et al.
7,929,147 B1 4/2011 Fong et al.
7,995,000 B2 8/2011 Manasson et al.
8,009,116 B2 8/2011 Peichl et al.
8,014,050 B2 9/2011 McGrew
8,040,586 B2 10/2011 Smith et al.
8,059,051 B2 11/2011 Manasson et al.
8,134,521 B2 3/2012 Herz et al.
8,179,331 B1 5/2012 Sievenpiper
8,212,739 B2 7/2012 Sievenpiper
8,339,320 B2 12/2012 Sievenpiper
8,456,360 B2 6/2013 Manasson et al.
9,231,303 B2 1/2016 Edelmann et al.
9,268,016 B2 2/2016 Smith et al.
9,385,435 B2 7/2016 Bily et al.
9,389,305 B2 7/2016 Boufounos
9,450,310 B2 9/2016 Bily et al.
9,634,736 B2 4/2017 Mukherjee et al.
2002/0039083 A1 4/2002 Taylor et al.
2002/0167456 A1 11/2002 McKinzie, III
2003/0214443 A1 11/2003 Bauregger et al.
2004/0227668 A1 11/2004 Sievenpiper
2004/0242272 A1 12/2004 Aiken et al.
2004/0263408 A1 12/2004 Sievenpiper et al.
2005/0031295 A1 2/2005 Engheta et al.
2005/0088338 A1 4/2005 Masenten et al.
2006/0065856 A1 3/2006 Diaz et al.
2006/0114170 A1 6/2006 Sievenpiper
2006/0116097 A1 6/2006 Thompson
2006/0132369 A1 6/2006 Robertson et al.
2006/0187126 A1 8/2006 Sievenpiper
2007/0085757 A1 4/2007 Sievenpiper
2007/0103381 A1 5/2007 Upton
2007/0159395 A1 7/2007 Sievenpiper et al.
2007/0159396 A1 7/2007 Sievenpiper et al.
2007/0182639 A1 8/2007 Sievenpiper et al.
2007/0200781 A1 8/2007 Ahn et al.
2007/0229357 A1 10/2007 Zhang et al.
2008/0020231 A1 1/2008 Yamada et al.
2008/0165079 A1 7/2008 Smith et al.
2008/0180339 A1 7/2008 Yagi
2008/0224707 A1 9/2008 Wisler et al.
2008/0259826 A1 10/2008 Struhsaker
2008/0268790 A1 10/2008 Shi et al.
2008/0316088 A1 12/2008 Pavlov et al.
2009/0002240 A1 1/2009 Sievenpiper et al.
2009/0045772 A1 2/2009 Cook et al.
2009/0109121 A1 4/2009 Herz et al.
2009/0147653 A1 6/2009 Waldman et al.
2009/0195361 A1 8/2009 Smith
2009/0251385 A1 10/2009 Xu et al.
2010/0066629 A1 3/2010 Sievenpiper
2010/0073261 A1 3/2010 Sievenpiper
2010/0079010 A1 4/2010 Hyde et al.
2010/0109972 A2 5/2010 Xu et al.
2010/0134370 A1 6/2010 Oh et al.
2010/0156573 A1 6/2010 Smith et al.
2010/0157929 A1 6/2010 Karabinis
2010/0188171 A1 7/2010 Mohajer-Iravani et al.
2010/0279751 A1 11/2010 Pourseyed et al.
2010/0328142 A1 12/2010 Zoughi et al.
2011/0065448 A1 3/2011 Song et al.

(56) References Cited

U.S. PATENT DOCUMENTS

| | | | | |
|---|---|---|---|---|
| 2011/0098033 | A1 | 4/2011 | Britz et al. | |
| 2011/0117836 | A1* | 5/2011 | Zhang | H01P 3/121 455/39 |
| 2011/0128714 | A1 | 6/2011 | Terao et al. | |
| 2011/0151789 | A1 | 6/2011 | Viglione et al. | |
| 2011/0267664 | A1 | 11/2011 | Kitamura et al. | |
| 2012/0026068 | A1 | 2/2012 | Sievenpiper | |
| 2012/0038317 | A1 | 2/2012 | Miyamoto et al. | |
| 2012/0112543 | A1 | 5/2012 | van Wageningen et al. | |
| 2012/0194399 | A1 | 8/2012 | Bily et al. | |
| 2012/0219249 | A1* | 8/2012 | Pitwon | G02B 6/138 385/14 |
| 2012/0268340 | A1 | 10/2012 | Capozzoli et al. | |
| 2012/0274147 | A1 | 11/2012 | Stecher et al. | |
| 2012/0280770 | A1 | 11/2012 | Abhari et al. | |
| 2012/0326660 | A1 | 12/2012 | Lu et al. | |
| 2013/0069865 | A1 | 3/2013 | Hart | |
| 2013/0082890 | A1* | 4/2013 | Wang | H01Q 1/286 343/770 |
| 2013/0237272 | A1 | 9/2013 | Prasad | |
| 2013/0249310 | A1 | 9/2013 | Hyde et al. | |
| 2013/0278211 | A1 | 10/2013 | Cook et al. | |
| 2013/0288617 | A1 | 10/2013 | Kim et al. | |
| 2013/0324076 | A1 | 12/2013 | Harrang | |
| 2013/0343208 | A1 | 12/2013 | Sexton et al. | |
| 2014/0128006 | A1 | 5/2014 | Hu | |
| 2014/0266946 | A1 | 9/2014 | Bily et al. | |
| 2015/0189568 | A1 | 7/2015 | Stanze et al. | |
| 2015/0280444 | A1 | 10/2015 | Smith et al. | |
| 2017/0098961 | A1 | 4/2017 | Harpham | |
| 2017/0250746 | A1 | 8/2017 | Wang et al. | |

FOREIGN PATENT DOCUMENTS

| | | | |
|---|---|---|---|
| JP | 06-090110 | | 3/1994 |
| JP | 2007-081825 | A | 3/2007 |
| JP | 2008-054146 | A | 3/2008 |
| JP | 2008054146 | A | 3/2008 |
| JP | 2010147525 | A | 7/2010 |
| JP | 2010-187141 | A | 8/2010 |
| JP | 2012085145 | A | 4/2012 |
| KR | 10-1045585 | B1 | 6/2011 |
| WO | WO 01/73891 | A1 | 10/2001 |
| WO | WO 2008-007545 | A1 | 1/2008 |
| WO | WO 2008/059292 | A2 | 5/2008 |
| WO | WO 2009/103042 | A2 | 8/2009 |
| WO | WO 2010/0021736 | | 2/2010 |
| WO | WO 2012/050614 | A1 | 4/2012 |
| WO | PCT/US2013/212504 | | 5/2013 |
| WO | WO 2013/147470 | A1 | 10/2013 |
| WO | WO 2014/018052 | A1 | 1/2014 |

OTHER PUBLICATIONS

Abdalla et al.; "A Planar Electronically Steerable Patch Array Using Tunable PRI/NRI Phase Shifters"; IEEE Transactions on Microwave Theory and Techniques; Mar. 2009; p. 531-541; vol. 57, No. 3; IEEE.

Amineh et al.; "Three-Dimensional Near-Field Microwave Holography for Tissue Imaging"; International Journal of Biomedical Imaging; Bearing a date of Dec. 21, 2011; pp. 1-11; vol. 2012, Article ID 291494: Hindawi Publishing Corporation.

"Array Antenna with Controlled Radiation Pattern Envelope Manufacture Method"; ESA; Jan. 8, 2013; pp. 1-2; http://www.esa.int/Our_Activities/Technology/Array_antenna_with_controlled_radiation_pattern_envelope_manufacture_method.

Belloni, Fabio; "Channel Sounding"; S-72.4210 PG Course in Radio Communications; Bearing a date of Feb. 7, 2006; pp. 1-25.

Chen, Robert; *Liquid Crystal Displays*, Wiley, New Jersey 2011 (not provided).

Chin, J.Y. et al.; "An efficient broadband metamaterial wave retarder"; Optics Express; vol. 17, No. 9; p. 7640-7647; 2009.

Chu, R. S. et al.; "Analytical Model of a Multilayered Meaner-Line Polarizer Plate with Normal and Oblique Plane-Wave Incidence"; IEEE Trans. Ant. Prop.; vol. AP-35, No. 6; p. 652-661; Jun. 1987.

Colburn et al.; "Adaptive Artificial Impedance Surface Conformal Antennas"; in Proc. IEEE Antennas and Propagation Society Int. Symp.; 2009; p. 1-4.

Courreges et al.; "Electronically Tunable Ferroelectric Devices for Microwave Applications"; *Microwave and Millimeter Wave Technologies from Photonic Bandgap Devices to Antenna and Applications*; ISBN 978-953-7619-66-4; Mar. 2010; p. 185-204; InTech.

Cristaldi et al., Chapter 3 "Passive LCDs and Their Addressing Techniques" and Chapter 4 "Drivers for Passive-Matrix LCDs"; *Liquid Crystal Display Drivers: Techniques and Circuits*; ISBN 9048122546; Apr. 8, 2009; p. 75-143; Springer.

Den Boer, Wilem; *Active Matrix Liquid Crystal Displays*; Elsevier, Burlington, MA, 2009 (not provided).

Diaz, Rudy; "Fundamentals of EM Waves"; Bearing a date of Apr. 4, 2013; 6 total pages, located at: http://www.microwaves101.com/encycolpedia/absorbingradar1.cfm.

Elliott, R.S.; "An Improved Design Procedure for Small Arrays of Shunt Slots"; Antennas and Propagation, IEEE Transaction on; Jan. 1983; p. 297-300; vol. 31, Issue: 1; IEEE.

Elliott, Robert S. and Kurtz, L.A.; "The Design of Small Slot Arrays"; Antennas and Propagation, IEEE Transactions on; Mar. 1978; p. 214-219; vol. AP-26, Issue 2; IEEE.

European Patent Office, Supplementary European Search Report, pursuant to Rule 62 EPC; App. No. EP 11 83 2873; dated May 15, 2014; 7 pages.

Evlyukhin, Andrey B. and Bozhevolnyi, Sergey I.; "Holographic evanescent-wave focusing with nanoparticle arrays"; Optics Express; Oct. 27, 2008; p. 17429-17440; vol. 16, No. 22; OSA.

Fan, Yun-Hsing et al.; "Fast-response and scattering-free polymer network liquid crystals for infrared light modulators"; Applied Physics Letters; Feb. 23, 2004; p. 1233-1235; vol. 84, No. 8; American Institute of Physics.

Fong, Bryan H. et al.; "Scalar and Tensor Holographic Artificial Impedance Surfaces" IEEE Transactions on Antennas and Propagation; Oct. 2010; p. 3212-3221; vol. 58, No. 10; IEEE.

Frenzel, Lou; "What's the Difference Between EM Near Field and Far Field?"; Electronic Design; Bearing a date of Jun. 8, 2012; 7 total pages; located at: http://electronicdesign.com/energy/what-s-difference-between-em-field-and-far-field.

Grbic, Anthony; "Electrical Engineering and Computer Science"; University of Michigan; Create on Mar. 18, 2014, printed on Jan. 27, 2014; pp. 1-2; located at http;//sitemaker.umich.edu/agrbic/projects.

Grbic et al.; "Metamaterial Surfaces for Near and Far-Field Applications"; 7$^{th}$ European Conference on Antennas and Propagation (EUCAP 2013); Bearing a date of 2013, Created on Mar. 18, 2014; pp. 1-5.

Hand, Thomas H. et al.; "Characterization of complementary electric field coupled resonant surfaces"; Applied Physics Letters; published on Nov. 26, 2008; pp. 212504-1-212504-3; vol. 93; Issue 21; American Institute of Physics.

Imani et al.; "A Concentrically Corrugated Near-Field Plate"; Bearing a date of 2010; Created on Mar. 18, 2014; pp. 1-4; IEEE.

Imani et al.; "Design of a Planar Near-Field Plate"; Bearing at date of 2012, Created on Mar. 18, 2014; pp. 102, IEEE.

Imani et al.; "Planar Near-Field Plates"; Bearing a date of 2013, Create on Mar. 18, 2014; pp. 1-10; IEEE.

Islam et al.; "A Wireless Channel Sounding System for Rapid Propagation Measurements"; Bearing a date of Nov. 21, 2012, 7 total pages.

Kaufman, D.Y. et al.; "High-Dielectric-Constant Ferroelectric Thin Film and Bulk Ceramic Capacitors for Power Electronics"; Proceedings of the Power Systems World/Power Conversion and Intelligent Motion '99 Conference; Nov. 6-12, 1999; p. 1-9; PSW/PCIM; Chicago, IL.

Kim, David Y.; "A Design Procedure for Slot Arrays Fed by Single-Ridge Waveguide"; IEEE Transactions on Antennas and Propagation; Nov. 1988; p. 1531-1536; vol. 36, No. 11; IEEE.

Kirschbaum, H.S. et al.; "A Method of Producing Broad-Band Circular Polarization Employing an Anisotropic Dielectric"; IRE Trans. Micro. Theory. Tech.; vol. 5, No. 3; p. 199-203; 1957.

(56) References Cited

OTHER PUBLICATIONS

Kokkinos, Titos et al.; "Periodic FDTD Analysis of Leaky-Wave Structures and Applications to the Analysis of Negative-Refractive-Index Leaky-Wave Antennas"; IEEE Transactions on Microwave Theory and Techniques; 2006; p. 1-12; ; IEEE.
Konishi, Yohei; "Channel Sounding Technique Using MIMO Software Radio Architecture"; 12th MCRG Joint Seminar: Bearing a date of Nov. 18, 2010; 28 total pages.
Kuki, Takao et al., "Microwave Variable Delay Line using a Membrane Impregnated with Liquid Crystal"; Microwave Symposium Digest; ISBN 0-7803-7239-5; Jun. 2-7, 2002; p. 363-366; IEEE MTT-S International.
Leveau et al.; "Anti-Jam Protection by Antenna"; GPS World; Feb. 1, 2013; pp. 1-11; North Coast Media LLC; http://gpsworld.com/anti-jam-protection-by_-antenna/.
Lipworth et al.; "Magnetic Metamaterial Superlens for Increase Range Wireless Power Transfer"; Scientific Reports; Bearing a date of January 101, 2014; pp. 1-6; vol. 4, No. 3642.
Luo et al.; "Hig-directivity antenna with small antenna aperture"; Applied Physics Letters; 2009; pp. 193506-1-193506-3; vol. 95; American Institute of Physics.
Manasson et al.; "Electronically Reconfigurable Aperture (ERA): A New Approach for Beam-Steering Technology"; Bearing dates of Oct. 12-15, 2010; pp. 673-679; IEEE.
McLean et al.; "Interpreting Antenna Performance Parameters for EMC Applications: Part 2: Radiation Patter, Gain, and Directivity"; Created on Apr. 1, 2014; pp. 7-17; TDK RF Solutions Inc.
Mitri, F.G.; "Quasi-Gaussian Electromagnetic Beams"; Physical Review A.; Bearing a date of Mar. 11, 2013; p. 1; vol. 87, No. 035804; (Abstract Only).
Ovi et al.; "Symmetrical Slot Loading in Elliptical Microstrip Patch antennas Partially Filled with Mue Negative Metamaterials"; PIERS Proceedings, Moscow, Russia; Aug. 19-23, 2012; pp. 542-545.
PCT International Search Report; International App. No. PCT/US2014/017454; dated Aug. 28, 2014; pp. 1-4.
PCT International Search Report; International App. No. PCT/US2011/001755; dated Mar. 22, 2012; pp. 1-5.
Poplavlo, Yuriy et al.; "Tunable Dielectric Microwave Devices with Electromechanical Control"; *Passive Microwave Components and Antennas*; ISBN 978-953-307-083-4; Apr. 2010; p. 367-382; InTech.
Rengarajan, Sembiam R. et al.; "Design, Analysis, and Development of a Large Ka-Band Slot Array for Digital Beam-Forming Application"; IEEE Transactions on Antennas and Propagation; Oct. 2009; p. 3103-3109; vol. 57, No. 10; IEEE.
Sakakibara, Kunio; "High-Gain Millimeter-Wave Planar Array Antennas with Traveling-Wave Excitation"; Radar Technology; Bearing a date of Dec. 2009; pp. 319-340.
Sandell et al.; "Joint Data Detection and Channel Sounding for TDD Systems with Antenna Selection"; Bearing a date of 2011, Created on Mar. 18, 2014; pp. 1-5; IEEE.
"Satellite Navigation"; Crosslink; The Aerospace Corporation magazine of advances in aerospace technology; Summer 2002; vol. 3, No. 2; pp. 1-56; The Aerospace Corporation.
Sato, Kazuo et al.; "Electronically Scanned Left-Handed Leaky Wave Antenna for Millimeter-Wave Automotive Applications"; Antenna Technology Small Antennas and Novel Metamaterials; 2006; p. 420-423; IEEE.
Siciliano et al.; "25. Multisensor Data Fusion"; Springer Handbook of Robotics; Bearing a date of 2008, Created on Mar. 18, 2014; 27 total pages; Springer.
Sievenpiper, Dan et al.; "Holographic Artificial Impedance Surfaces for Conformal Antennas"; Antennas and Propagation Society International Symposium; 2005; p. 256-259; vol. 1B; IEEE, Washington D.C.
Sievenpiper, Daniel F. et al.; "Two-Dimensional Beam Steering Using an Electrically Tunable Impedance Surface"; IEEE Transactions on Antennas and Propagation; Oct. 2003; p. 2713-2722; vol. 51, No. 10; IEEE.
Smith, David R.; "Recent Progress in Metamaterial and Transformation Optical Design"; NAVAIR Nano/Meta Workshop; Feb. 2-3, 2011; pp. 1-32.
Soper, Taylor; "This startup figured out how to charge devices wirelessly through walls from 40 feet away"; GeekWire; bearing a date of Apr. 22, 2014 and printed on Apr. 24, 2014; pp. 1-12; located at http://www.geekwire.com/2014/ossia-wireless-charging/#disqus_thread.
"Spectrum Analyzer"; Printed on Aug. 12, 2013; pp. 1-2; http://www.gpssource.com/faqs15; GPS Source.
Sun et al.; "Maximum Signal-to-Noise Ratio GPS Anti-Jam Receiver with Subspace Tracking"; ICASSP; 2005; pp. IV-1085-IV-1088; IEEE.
Thoma et al.; "MIMO Vector Channel Sounder Measurement for Smart Antenna System Evaluation"; Created on Mar. 18, 2014; pp. 1-12.
Umenei, A.E.; "Understanding Low Frequency Non-Radiative Power Transfer"; Bearing a date of Jun. 2011; 7 total pages; Fulton Innovation LLC.
Utsumi, Yozo et al.; "Increasing the Speed of Microstrip-Line-Type Polymer-Dispersed Liquid-Crystal Loaded Variable Phase Shifter"; IEEE Transactions on Microwave Theory and Techniques; Nov. 2005, p. 3345-3353; vol. 53, No. 11; IEEE.
Wallace, John; "Flat 'Metasurface' Becomes Aberration-Free Lens"; Bearoing a date of Aug. 28, 2012; 4 total pages; located at: http://www.laserfocusworld.com/articles/2012/08/flat-metasurface-becomes-aberration-free-lens.html.
"Wavenumber"; Microwave Encyclopedia; bearing a date of Jan. 12, 2008; pp. 1-2 P-N Designs, Inc.
Weil, Carsten et al.; "Tunable Inverted-Microstrip Phase Shifter Device Using Nematic Liquid Crystals"; IEEE MTT-S Digest; 2002; p. 367-370; IEEE.
Yan, Dunbao et al.; "A Novel Polarization Convert Surface Based on Artificial Magnetic Conductor"; Asia-Pacific Microwave Conference Proceedings, 2005.
Yee, Hung Y.; "Impedance of a Narrow Longitudinal Shunt Slot in a Slotted Waveguide Array"; IEEE Transactions on Antennas and Propagation; Jul. 1974; p. 589-592; IEEE.
Yoon et al.; "Realizing Efficient Wireless Power Transfer in the Near-Field Region Using Electrically small Antennas"; Wireless Power Transfer; Principles and Engineering Explorations: Bearing a date of Jan. 25, 2012; pp. 151-172.
Young et al.; "Meander-Line Polarizer"; IEEE Trans. Ant. Prop.; p. 376-378; May 1973.
Zhong, S.S. et al.; "Compact ridge waveguide slot antenna array fed by convex waveguide divider"; Electronics Letters; Oct. 13, 2005; p. 1-2; vol. 41, No. 21; IEEE.
Canadian Intellectual Property Office, Canadian Examination Search Report, Pursuant to Subsection 30(2); App. No. 2,814,635; dated Dec. 1, 2016; pp. 1-3.
Chinese State Intellectual Property Office, Notification of Fourth Office Action, App. No. 2011/80055705.8 (Based on PCT Patent Application No. PCT/US2011/001755); dated May 20, 2016; pp. 1-4 (machine translation only).
PCT International Search Report; International App. No. PCT/US2015/028781; dated Jul. 27, 2015; pp. 1-3.
PCT International Search Report; International App. No. PCT/US2014/061485; dated Jul. 27, 2015; pp. 1-3.
PCT International Search Report; International App. No. PCT/US2014/070650; dated Mar. 27, 2015; pp. 1-3.
PCT International Search Report; International App. No. PCT/US2014/070645; dated Mar. 16, 2015; pp. 1-3.
The State Intellectual Property Office of P.R.C, Fifth Office Action, App. No. 2011/80055705.8 (Based on PCT Patent Application No. PCT/US2011/001755); dated Nov. 16, 2016; pp. 1-3 (machine translation, as provided).
European Search Report; European App. No. EP 11 832 873.1; dated Sep. 21, 2016; pp. 1-6.
PCT International Search Report; International App. No. PCT/US2016/037667; dated Sep. 7, 2016; pp. 1-3
The State Intellectual Property Office of P.R.C.; Application No. 201180055705.8; dated Nov. 4, 2015; pp. 1-11.

(56) References Cited

OTHER PUBLICATIONS

PCT International Search Report; International App. No. PCT/US2014/069254; dated Nov. 27, 2015; pp. 1-4.
Patent Office of the Russian Federation (Rospatent) Office Action; Application No. 2013119332/28(028599); dated Oct. 13, 2015; machine translation; pp. 1-5.
Definition from Merriam-Webster Online Dictionary; "Integral"; Merriam-Webster Dictionary; printed by Examiner on Dec. 8, 2015; pp. 1-5; located at: http://www.merriam-webster.com/dictionary/integral.
Varlamos et al.; "Electronic Beam Steering Using Switched Parasitic Smart Antenna Arrays"; Progress in Electromagnetics Research; PIER 36; bearing a date of 2002; pp. 101-119.
Fan, Guo-Xin et al.; "Scattering from a Cylindrically Conformal Slotted Waveguide Array Antenna"; IEEE Transactions on Antennas and Propagation; Jul. 1997; pp. 1150-1159; vol. 45, No. 7; IEEE.
Jiao, Yong-Chang et al.; A New Low-Side-Lobe Pattern Synthesis Technique for Conformal Arrays; IEEE Transactions on Antennas and Propagation; Jun. 1993; pp. 824-831, vol. 41, No. 6; IEEE.
The State Intellectual Property Office of P.R.C.; Application No. 201180055705.8; May 6, 2015; pp. 1-11.
Intellectual Property Office of Singapore Examination Report; Application No. 2013027842; dated Feb. 27, 2015; pp. 1-12.
PCT International Search Report; International App. No. PCT/US2015/036638; dated Oct. 19, 2015; pp. 1-4.
Extended European Search Report; European App. No. EP 14 77 0686; dated Oct. 14, 2016; pp. 1-7.
IP Australia Patent Examination Report No. 1; Patent Application No. 2011314378; dated Mar. 4, 2016; pp. 1-4.
European Patent Office, Supplementary European Search Report, Pursuant to Rule 62 EPC; App. No. EP 14891152; dated Jul. 20, 2017; pp. 1-4.
Supplementary European Search Report, Pursuant to Rule 62 EPC; App. No. EP 14 87 2595; dated Jul. 3, 2017; pp. 1-16.
Supplementary European Search Report, Pursuant to Rule 62 EPC; App. No. EP 14 87 2874; dated Jul. 3, 2017; pp. 1-15.
"Aperture", Definition of Aperture by Merriam-Webster; located at http://www.merriam-webster.com/dictionary/aperture; printed by Examiner on Nov. 30, 2016; pp. 1-9; Merriam-Webster, Incorporated.
PCT International Preliminary Report on Patentability; International App. No. PCT/US2014/070645; dated Jun. 21, 2016; pp. 1-12.
European Patent Office, Supplementary European Search Report, Pursuant to Rule 62 EPC; App. No. EP 15 80 8884 ; dated Jan. 9, 2018; pp. 1-12.
Japan Patent Office, Office Action, App. No. 2016-500314 (based on PCT Patent Application No. PCT/US2014/017454); dated Mar. 6, 2018; pp. 1-4.
European Patent Office, Communication Pursuant to Article 94(3) EPC; App. No. 14770686.5; dated Mar. 28, 2019; pp. 1-22.
Checcacci et al.; "A Holographic VHF Antenna"; IEEE Transactions on Antennas and propagation; Mar. 1971; pp. 278-279.
Elsherbiny et al.; "Holographic Antenna Concept, Analysis, and Parameters"; IEEE Transactions on Antennas and Propagation; Mar. 2004; pp. 830-839; vol. 52; No. 3; 2004 IEEE.
Iizuka et al.; "Volume-Type Holographic Antenna"; IEEE Transactions on Antennas and Propagation; Nov. 1975; pp. 807-810.
Sazonov, Dimitry M; "Computer Aided Design of Holographic Antennas"; IEEE 1999; pp. 738-741
Chinese State Intellectual Property Office, Notification of the First Office Action, App. No. 201580042227.5 (based on PCT Patent Application No. PCT/US2015/036638); dated Sep. 30, 2018; (machine translation provided, 5 pages total).
European Patent Office, Extended European Search Report, Pursuant to Rule 62 EPC; App. No. EP 16812357; dated Dec. 3, 2018; pp. 1-7.
Smith et al.; "Composite Medium with Simultaneously Negative Permeability and Permitivity"; Physical Review Letters; May 1, 2000; pp. 4184-4187; vol. 84, No. 18; American Physical Society.
European Patent Office, Communication Pursuant to Article 94(3) EPC; App. No. EP 14872874.4; dated Jul. 16, 2018; pp. 1-8.
European Patent Office, Communication Pursuant to Article 94(3) EPC; App. No. EP 14872595.5; dated Jul. 16, 2018; pp. 1-7.
Korean Intellectual Property Office, Notice of Preliminary Rejection; dated Oct. 15, 2018 (machine translation provided); pp. 1-5.
Chinese State Intellectual Property Office, First Office Action, App. No. 2015/80036356.3 (based on PCT Patent Application No. PCT/US2015/028781); dated Sep. 5, 2018; machine translation provided, 6 pages total.
Chen, Hou-Tong; "A review of metasurfaces; physics and applications"; Reports on Progress in Physics; Mar. 9, 2016: pp. 1-60; IOP Publishing Ltd. 2016.
Chinese State Intellectual Property Office, First Office Action, App. No. 201480074759.2 (based on PCT Patent Application No. PCT/US2014/069254); dated Jul. 2, 2018; pp. 1-14 (machine translation provided).

* cited by examiner

CURVED SURFACE SCATTERING ANTENNAS

If an Application Data Sheet (ADS) has been filed on the filing date of this application, it is incorporated by reference herein. Any applications claimed on the ADS for priority under 35 U.S.C. §§ 119, 120, 121, or 365(c), and any and all parent, grandparent, great-grandparent, etc. applications of such applications, are also incorporated by reference, including any priority claims made in those applications and any material incorporated by reference, to the extent such subject matter is not inconsistent herewith.

CROSS-REFERENCE TO RELATED APPLICATIONS

The present application claims the benefit of the earliest available effective filing date(s) from the following listed application(s) (the "Priority Applications"), if any, listed below (e.g., claims earliest available priority dates for other than provisional patent applications or claims benefits under 35 USC § 119(e) for provisional patent applications, for any and all parent, grandparent, great-grandparent, etc. applications of the Priority Application(s)).

Priority Applications:

The present application constitutes a continuation-in-part of U.S. patent application Ser. No. 14/506,432, entitled SURFACE SCATTERING ANTENNAS WITH LUMPED ELEMENTS, naming Pai-Yen Chen, Tom Driscoll, Siamak Ebadi, John Desmond Hunt, Nathan Ingle Landy, Melroy Machado, Jay McCandless, Milton Perque, David R. Smith, and Yaroslav A. Urzhumov as inventors, filed 3, Oct. 2014, which is currently co-pending or is an application of which a currently co-pending application is entitled to the benefit of the filing date, and which is a non-provisional of U.S. Patent Application Ser. No. 61/988,023, entitled SURFACE SCATTERING ANTENNAS WITH LUMPED ELEMENTS, naming Pai-Yen Chen, Tom Driscoll, Siamak Ebadi, John Desmond Hunt, Nathan Ingle Landy, Melroy Machado, Jay McCandless, Milton Perque, David R. Smith, and Yaroslav A. Urzhumov as inventors, filed 2, May 2014.

The present application constitutes a continuation-in-part of U.S. patent application Ser. No. 14/549,928, entitled MODULATION PATTERNS FOR SURFACE SCATTERING ANTENNAS, naming Pai-Yen Chen, Tom Driscoll, Siamak Ebadi, John Desmond Hunt, Nathan Ingle Landy, Melroy Machado, Milton Perque, Jr., David R. Smith, Yaroslav Urzhumov as inventors, filed 21, Nov. 2014, which is currently co-pending or is an application of which a currently co-pending application is entitled to the benefit of the filing date, and which is a non-provisional of U.S. Patent Application No. 62/015,293, entitled MODULATION PATTERNS FOR SURFACE SCATTERING ANTENNAS, naming Pai-Yen Chen, Tom Driscoll, Siamak Ebadi, John Desmond Hunt, Nathan Ingle Landy, Melroy Machado, Milton Perque, Jr., David R. Smith, Yaroslav Urzhumov as inventors, filed 20, Jun. 2014.

The present application claims benefit of priority of U.S. Provisional Patent Application No. 61/992,699, entitled CURVED SURFACE SCATTERING ANTENNAS, naming Pai-Yen Chen, Tom Driscoll, Siamak Ebadi, John Desmond Hunt, Nathan Ingle Landy, Melroy Machado, Milton Perque, David R. Smith, and Yaroslav A. Urzhumov as inventors, filed 13, May 2014, which was filed within the twelve months preceding the filing date of the present application or is an application of which a currently co-pending priority application is entitled to the benefit of the filing date.

If the listings of applications provided above are inconsistent with the listings provided via an ADS, it is the intent of the Applicant to claim priority to each application that appears in the Domestic Benefit/National Stage Information section of the ADS and to each application that appears in the Priority Applications section of this application.

All subject matter of the Priority Applications and of any and all applications related to the Priority Applications by priority claims (directly or indirectly), including any priority claims made and subject matter incorporated by reference therein as of the filing date of the instant application, is incorporated herein by reference to the extent such subject matter is not inconsistent herewith.

DETAILED DESCRIPTION

Figure 1:
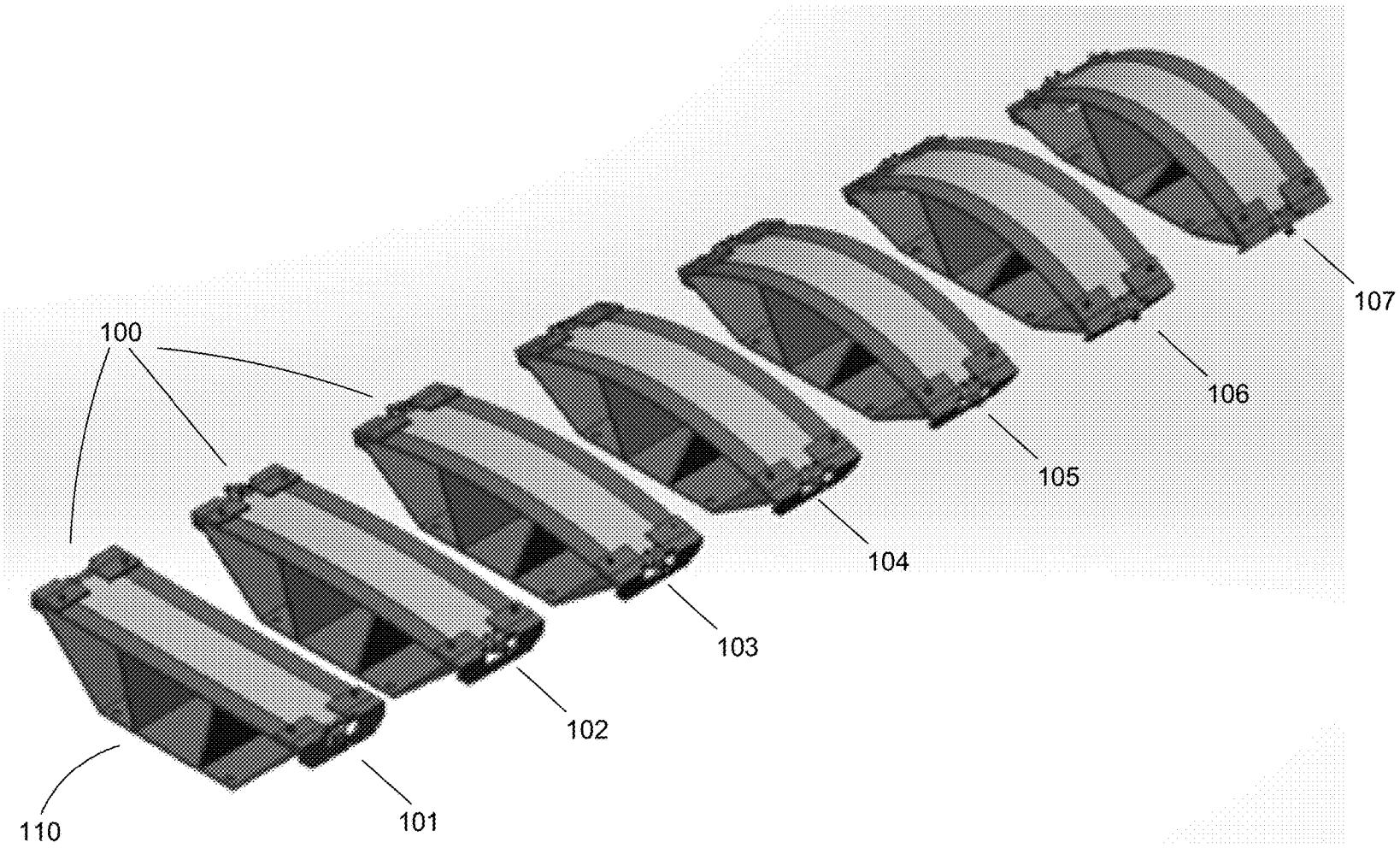
FIG. 1 depicts curved surface antennas.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

The embodiments relate to curved or conformal surface scattering antennas. Surface scattering antennas are described, for example, in U.S. Patent Application Publication No. 2012/0194399 (hereinafter "Bily I"), with improved surface scattering antennas being further described in U.S. Patent Application Publication No. 2014/0266946 (hereinafter "Bily II"). Surface scattering antennas that include adjustable radiative elements loaded with lumped elements are described in U.S. application Ser. No. 14/506,432 (hereinafter "Chen I"), while various holographic modulation pattern approaches are described in U.S. patent application Ser. No. 14/549,928 ("hereinafter Chen II"). All of these patent applications are herein incorporated by reference in their entirety.

Turning now to a consideration of the curved or conformal embodiments, it is to be appreciated that any of the various approaches described in the above-mentioned patent applications can be implemented in a non-planar fashion. Thus, for example, the circuit board assemblies of Chen I's FIGS. 9A-12B may be implemented with a semirigid or flexible laminate process, the resultant assembly being then bent or flexed to conform to a particular nonplanar geometry, such as a curved surface of a vehicle (e.g. the curved body of an automobile, the curved wing or fuselage of an aerial vehicle). FIG. 1 depicts an example of such a conformal antenna, comprising a semirigid or flexible circuit board assembly 100 mounted on a mandril 110 providing varying degrees of curvature 101-107 corresponding to arcs spanning 0° (i.e. zero curvature), 15°, 30°, 45°, 60°, 75°, and 90°, respectively. The semirigid or flexible circuit board assembly 100 can be, for example, a semirigid microwave laminate PCB such as a ROGERS 4000 SERIES laminate; or a flexible circuit board assembly of polyimide copper clad laminates such as DUPONT PYRALUX™ or KAPTON™ or liquid crystal polymer (LCP) dielectric films such as ROGERS ULTRALAM™.

In one approach, the antenna includes a one-dimensional waveguide that is bent to conform to general one-dimensional manifold. In another approach, the antenna includes a plurality of parallel one-dimensional waveguides (e.g. as depicted in Chen I's FIG. 5) that are bent to conform to two-dimensional manifold having a curvature in only one direction (e.g. a cylinder or corrugated surface). In yet another approach, the antenna includes a plurality of one-dimensional waveguides that are bent and laid down adjacently to conform to a general two-dimensional manifold having curvatures in two directions (e.g. where the one-dimensional waveguides are placed along lines of latitude or longitude on a section of a sphere or ellipsoid).

In some approaches, the scattering elements of the curved or conformal antenna may be evenly spaced where the distances between elements are measured along direction(s) locally parallel to the one- or two-dimensional manifold on which the scattering elements reside. For example, for a curved one-dimensional manifold, the scattering elements may be positioned as if they were equally spaced along an inelastic string that is laid down to coincide with the manifold. In other approaches, the scattering elements of the conformal antenna may be evenly spaced when the distances between elements are measured along a some fixed direction, e.g. a direction perpendicular to a "broadside" beam direction of the antenna. For example, for a curved one-dimensional manifold defined by a function $y=f(x)$, the scattering elements may be equally spaced along the one-dimensional manifold with x coordinates $x_0$, $x_0+a$, $x_0+2a$, etc. In yet other approaches, the scattering elements are positioned randomly or pseudo-randomly along the manifold.

In some embodiments, the curved antenna includes a plurality of lumped elements that are electrically connected to a semirigid or flexible curved circuit board. For example, a curved circuit board may implement a waveguide (e.g. a substrate-integrated waveguide, microstrip waveguide, or stripline waveguide) that is coupled to a plurality of subwavelength radiative elements such as patches or slots, and the patches or slots are loaded with lumped elements that are mounted to an upper surface of the circuit board. Various approaches may be used, alone or in combination, to preserve electrical connectivity between the lumped elements and the circuit board despite the bending or flexion of the board. In a first approach, the lumped elements are connected to an upper surface of the circuit board with an elastomeric conductive compound. In a second approach, the lumped elements are connected to an upper surface of the circuit board with flexible electrical contacts. For example, the lumped elements may have flexible metal feet that maintain a connection to the board despite flexion; or the lumped elements may be installed in sockets which are in turn electrically connected to the board, the sockets providing the desired flexion tolerance.

Figure 2:
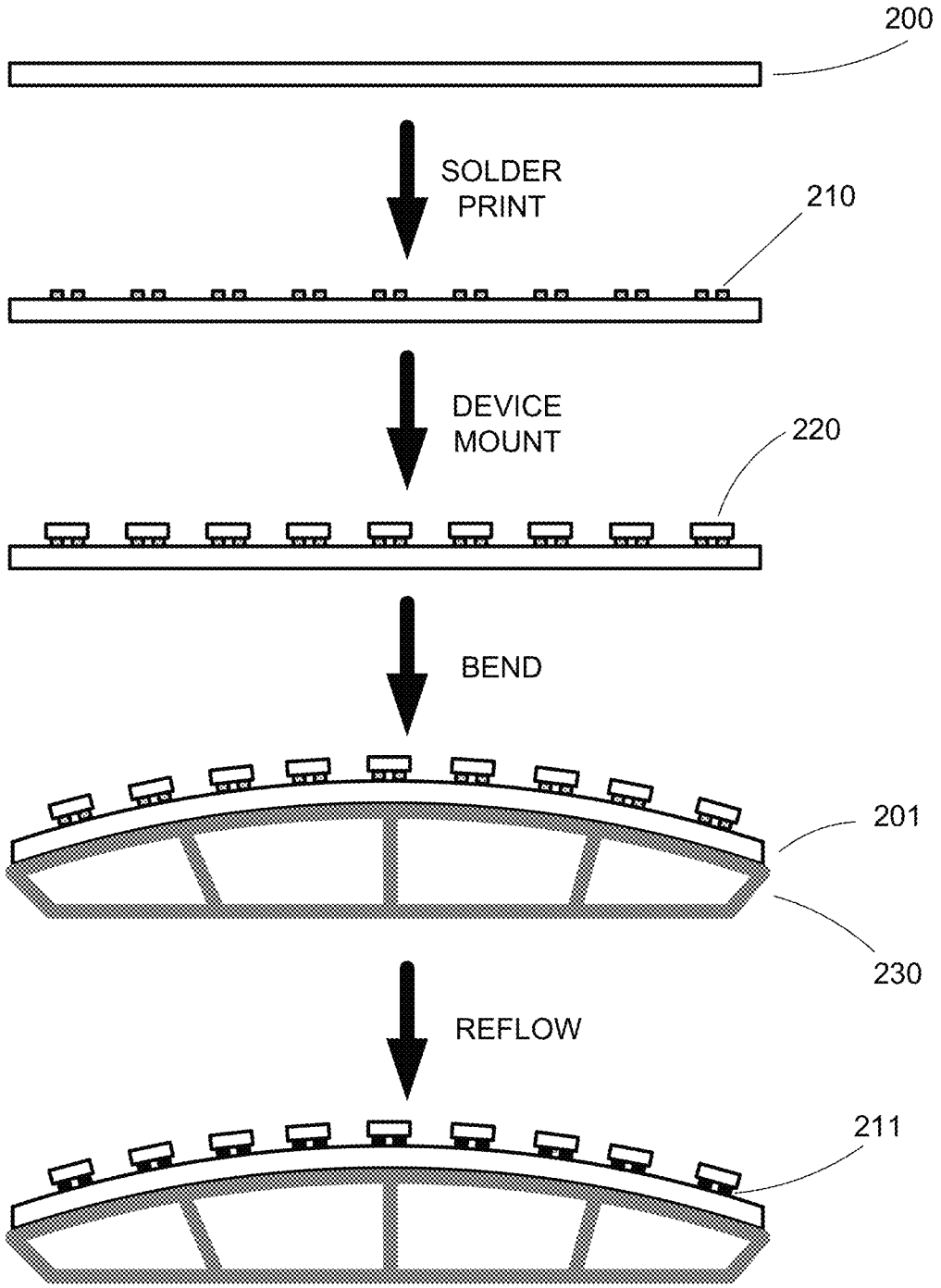
FIG. 2 depicts a fabrication of a curved surface antenna.

In a third approach, depicted in FIG. 2, the lumped elements are placed on a flat circuit board, and the board is then bent prior to solder reflow. The exemplary fabrication process begins with a flat circuit board 200 implementing the antenna waveguide with a plurality of subwavelength radiative elements to which lumped elements are to be attached. In a first manufacturing step, solder paste 210 is applied to the flat circuit board, e.g. using a solder stencil, to prepare the board for placement of the lumped elements. In a second manufacturing step, the lumped elements 220 are placed on the board, e.g. using a pick-and-place machine. In a third manufacturing step, prior to solder reflow, the board is bent to conform to a desired curvature, for example by attaching the board to a mandril or other rigid structure 230. In a final manufacturing step, the bent board 201 is placed in a solder reflow oven to provide reflowed solder connections 211. The final board may be kept on the mandril or other rigid structure (or placed on a similarly-shaped support structure) until final installation of the antenna, to avoid unintended flexion of the baked board, e.g. during antenna system assembly or during transit to the installation site. It will be appreciated that the various manufacturing steps described above may be carried out by a single party or by any combination of multiple parties. Thus, for example, various embodiments provide methods of receiving a board in a first state of completion of the fabrication process (including a state of zero completion), performing one or more of the above manufacturing steps, and delivering the board in a later state of completion (including a state of total completion).

Some embodiments provide methods of selecting or identifying an antenna configuration to provide a desired antenna radiation pattern. As discussed in the patent applications cited above, the guided wave or surface wave may be represented by a complex scalar input wave $\Psi_{in}$ that is a function of position along the wave-propagating structure. To produce an output wave that may be represented by another complex scalar wave $\Psi_{out}$, a pattern of adjustments of the scattering elements may be selected that corresponds to a hologram function, i.e. an interference pattern of the input and output waves along the wave-propagating structure. For example, the scattering elements may be adjusted to provide couplings to the guided wave or surface wave that are functions of (e.g. are proportional to, or binary/grayscale step-functions of) an interference term given by $\mathrm{Re}[\Psi_{out}\Psi^*_{in}]$. To determine the pattern of adjustment of the scattering elements, therefore, it may be desirable to know the input wave $\Psi_{in}$.

In some approaches, the input wave $\Psi_{in}$ may be analytically determinable. For example, for a linear waveguide with constant propagation characteristics along its length, the input wave may be an exponential function $\Psi_{in}\sim\exp(-n\omega x/c)\exp(-\alpha x)$ of distance x along the waveguide, where n is an effective refractive index of the waveguide and $\alpha$ is an attenuation coefficient of the waveguide. When a radius of curvature of the curved antenna is much larger than a wavelength of the guided wave or surface wave, a linear or planar solution for the input wave $\Psi_{in}$ may provide a good approximation of the input wave $\Psi_{in}$ on the slightly curved manifold. Alternatively, in some approaches the input wave $\Psi_{in}$ may be analytically expressed as a perturbation series in powers of a small parameter representing the small curvature of the manifold.

In other approaches, the input wave $\Psi_{in}$ may be numerically determinable. For example, for a given waveguide geometry corresponding to a curved manifold, a full-wave simulator such as CST MICROWAVE STUDIO may be used to calculate the input wave $\Psi_{in}$ as a function of position on the curved manifold.

In yet other approaches, the input wave $\Psi_{in}$ may be experimentally determinable. For example, the scattering elements may be adjusted for maximal coupling to the input wave, and an evanescent probe may be scanned along the physical aperture of the antenna to measure the response of each scattering element and thereby determine the amplitude and phase of the input wave $\Psi_{in}$ at the location of the scattering element. Alternatively, the curved antenna may be placed in a test environment with a measurement antenna in a proximity (near field or far field) of the curved antenna, and the signal received at the measurement antenna may be recorded for a series of adjustment patterns of the scattering elements. This series of adjustment patterns could be, for example, a "walking ones" pattern where each of the scattering elements is successively turned "on" (with all the other scattering elements "off"), or some other set of patterns. From this set of measurements with the measurement antenna, the input wave $\Psi_{in}$ can be reconstructed.

Figure 3:
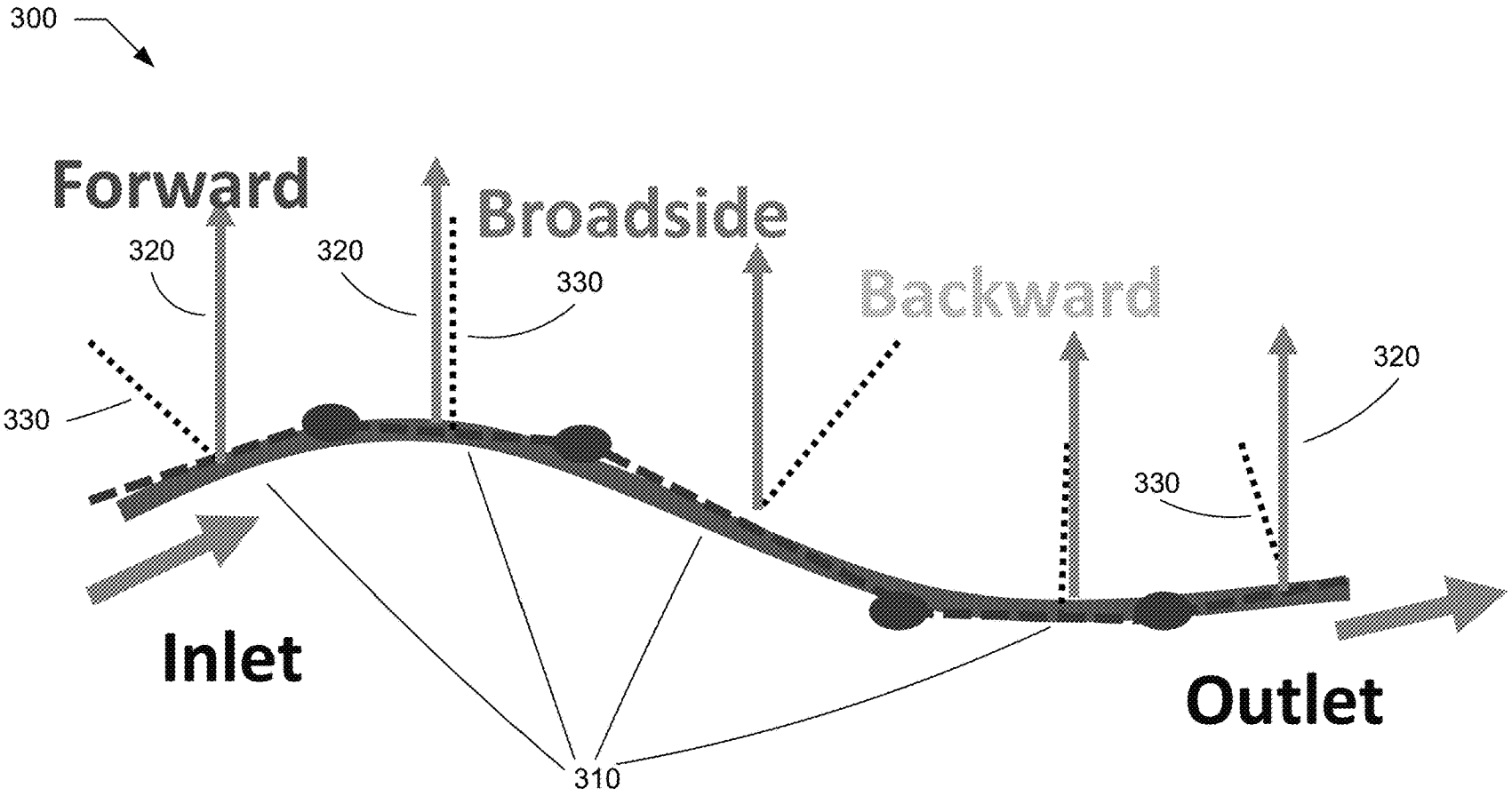
FIG. 3 depicts a piecewise linear approach for a curved surface antenna.
Figure 4:
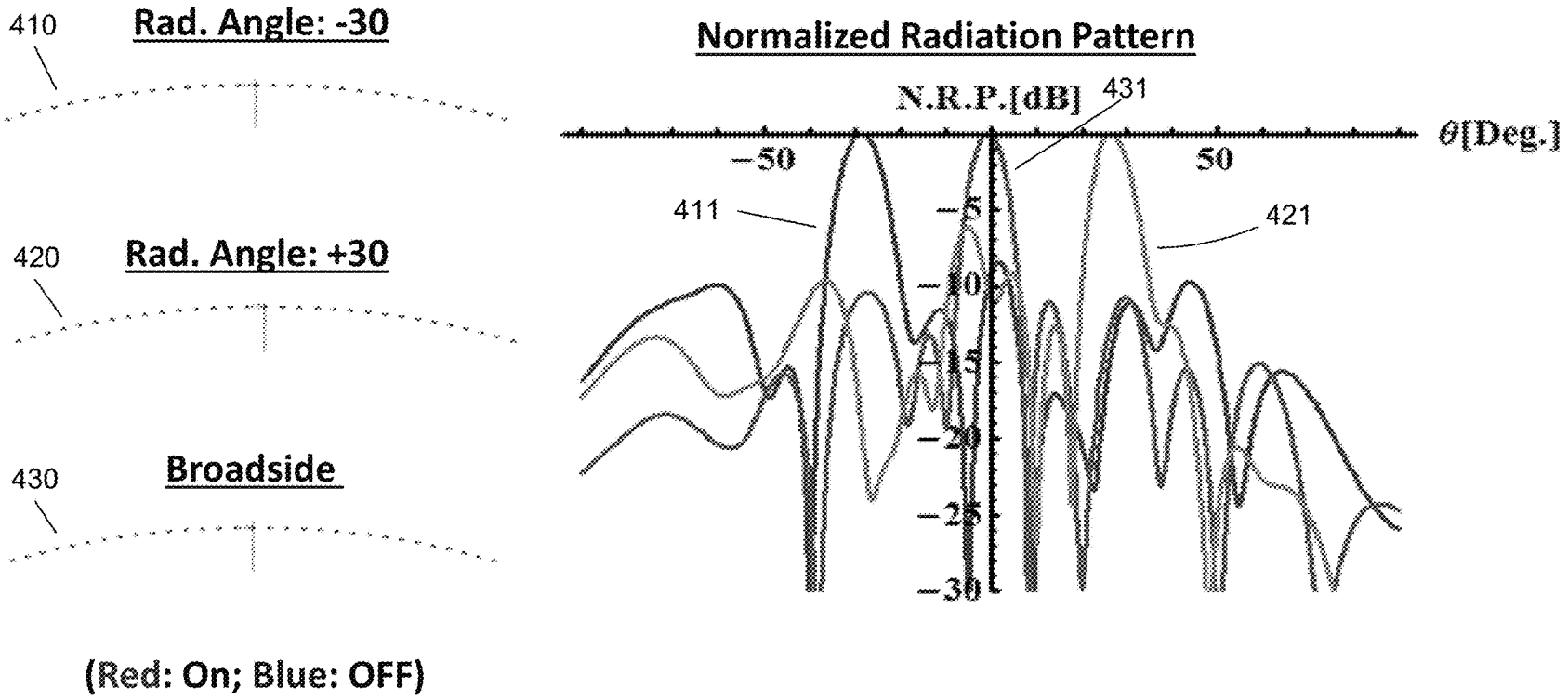
FIG. 4 depicts a simulation of the piecewise linear approach.

In some approaches, the pattern of adjustments of the scattering elements may be determined by approximating the curved manifold of the antenna as a collection of piecewise linear or piecewise planar sections. Then, to obtain a desired far field radiation pattern $R(\theta, \varphi)$ , each section is configured as if it were a separate antenna providing that same radiation pattern, but taking into account the particular orientation of the section. For example, as shown in FIG. 3, a curved one-dimensional antenna 300 can be treated as a series of piecewise linear sections 310; then, to beam radiation in direction 320, each section is adjusted to cast a "forward," "backward," or "broadside" beam, depending on the local normal vector 330 of the segment. A simulation of this piecewise approach is shown in FIG. 4, which depicts three adjustment patterns 410, 420, and 430 corresponding to beam directions −30°, +30°, and 0° (broadside), respectively, for an antenna that is a 30° arc segment. In this simulation, the set of elements was divided into six zones, and each zone was treated as a piecewise linear sub-antenna. The resultant radiation patterns 411, 421, and 431 are shown in the right panel, showing that the intended beam steering is accomplished.

In some approaches, the identifying of an antenna configuration includes applying one or more algorithms to reduce artifacts attributable to the discretization of the hologram function on the curved antenna. The antenna configuration may be regarded as a discretization of the hologram function because the adjustable scattering elements are positioned at a discrete plurality of locations and/or because each adjustable scattering element each has a discrete set of adjustments (i.e. a "binary" set of adjustments or a "grayscale" set of adjustments) used to approximate the function values of the hologram function. It will be appreciated that most or all of the approaches described in Chen II can be applied in the context of a curved antenna to reduce the discretization artifacts. For example, the locations of the scattering elements along the curved antenna may be actually or virtually dithered; the antenna configuration may be updated according to an error diffusion algorithm; the antenna configuration may be selected by exploring a neighborhood of beam directions and/or phases for a desired beam direction; the antenna configuration can be selected to optimize a desired cost function; etc.

Figure 5A:
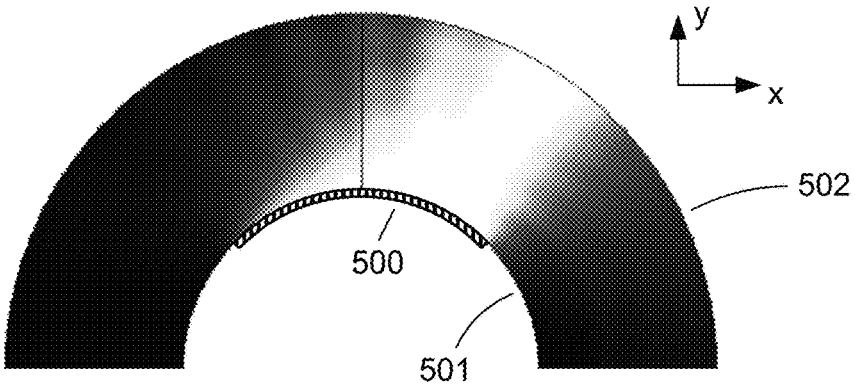
FIGS. 5A-5C depict a curved antenna optimized to direct a beam at a 45° angle from broadside.
Figure 5B:
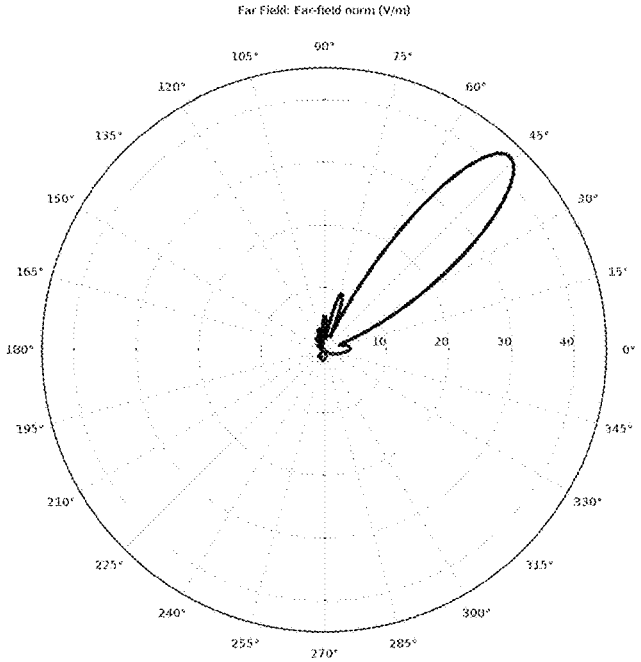
Figure 5C:
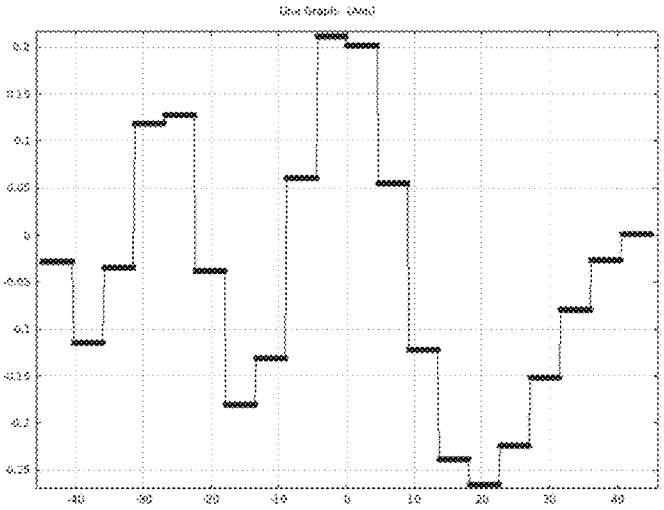
Figure 6A:
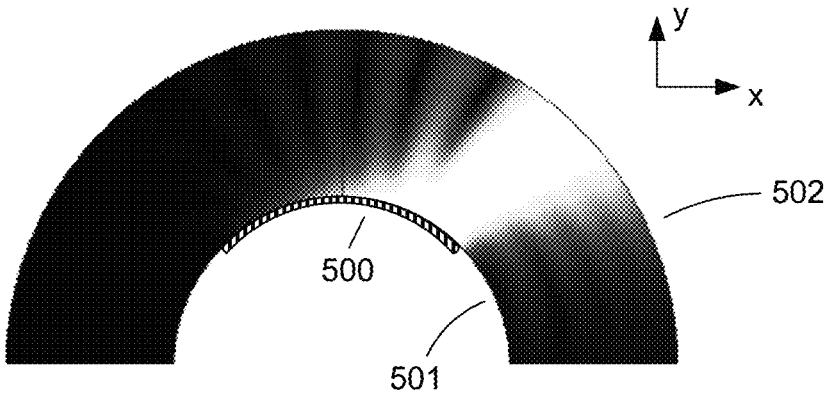
FIGS. 6A-6C depict a curved antenna optimized to direct a beam at a 60° angle from broadside.
Figure 6B:
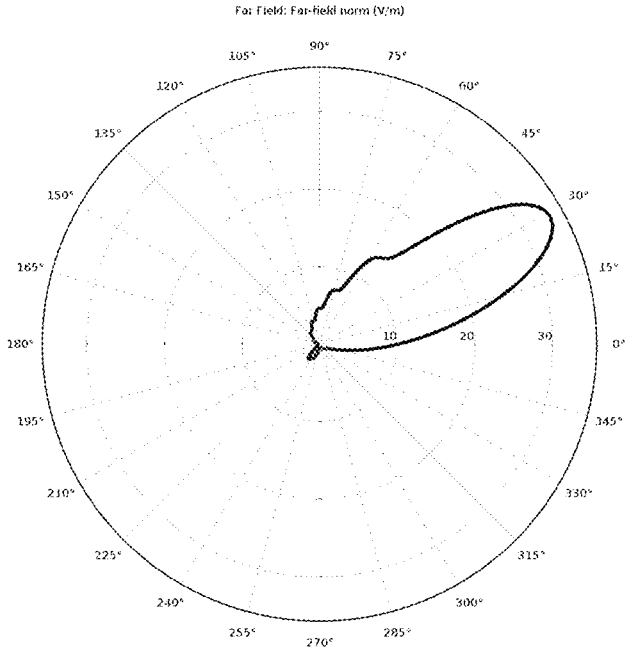
Figure 6C:
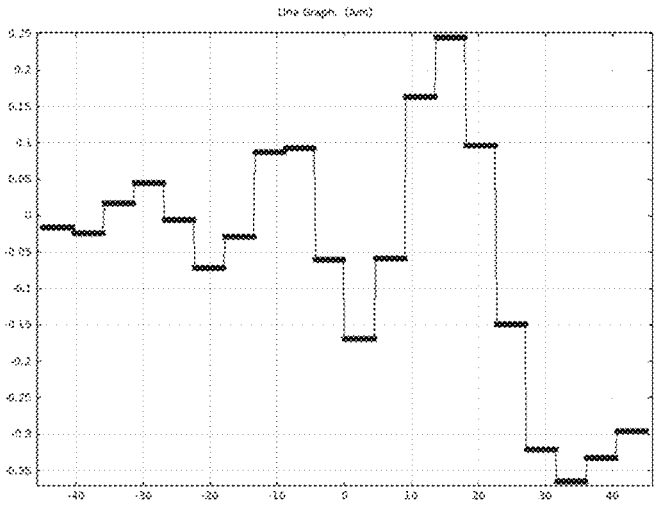

An example illustrating the utility of an optimization approach is depicted in FIGS. 5A-6C. The figures provide simulation and optimization results for a model antenna 500 that spans a 90° arc having a broadside in the +y direction. For modelling purposes, the antenna rests on a perfectly-matched layer that is an entire cylinder 501, but this modelling choice is not intended to be limiting. In FIGS. 5A-5C, the antenna has been configured to direct a beam at a +45° angle from broadside; in FIGS. 6A-6C, the antenna has been configured to direct a beam at a +60° angle from broadside. FIGS. 5A and 6A depict the radiated field between an inner PML 501 and an outer PML 502; FIGS. 5B and 6B depict polar plots of the far-field radiation pattern, showing beams directed at +45° and +60° from broadside, respectively; and FIGS. 5C and 6C show the real part of the optimized current distributions along the antenna aperture, here discretized as 20 arc segments of approximately 4.5°. The discretized current distributions here represent a product of the input wave times the hologram function imposed on the aperture, so knowledge of the input wave would allow the antenna designer to "back out" the appropriate optimized hologram functions to provide the beam patterns shown. It is noteworthy that the curved antenna allows a high-quality beam even at extreme angles from broadside (e.g. at 60° from broadside as shown) by virtue of the fact that the curvature provides a "local" broadside for a wider range of angles than a flat antenna.

Figure 7:
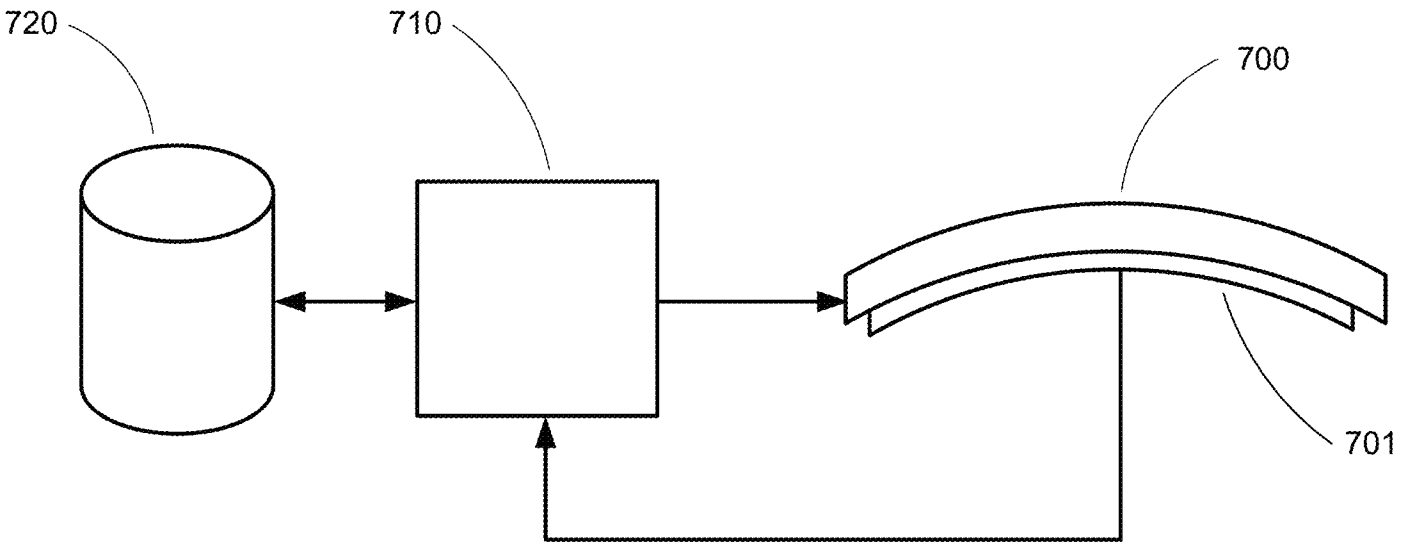
FIG. 7 depicts a system block diagram.

With reference now to FIG. 7, an illustrative embodiment is depicted as a system block diagram. The system includes a curved surface scattering antenna 700 coupled to control circuitry 710 operable to adjust the curved antenna to any particular antenna configuration. The system optionally includes a storage medium 720 on which is written a set of pre-calculated antenna configurations. For example, the storage medium may include a look-up table of antenna configurations indexed by some relevant operational parameter of the antenna, such as beam direction, each stored antenna configuration being previously calculated according to one or more of the approaches described above (and/or in Chen II). Then, the control circuitry 710 would be operable to read an antenna configuration from the storage medium and adjust the antenna to the selected, previously-calculated antenna configuration. Alternatively, the control circuitry 710 may include circuitry operable to calculate an antenna configuration according to one or more of the approaches described above (and/or in Chen II), and then to adjust the antenna for the presently-calculated antenna configuration.

In some approaches the curved antenna 700 may be a flexible curved antenna, i.e. an antenna capable of having a time-variable curvature, such as an antenna implemented with a flexible PCB laminate process. In these approaches the antenna optionally includes a set of strain gauges 701 mechanically coupled to the antenna to provide a readout of the instantaneous curvature of the antenna. The strain gauges 701 may in turn be coupled to the control circuitry 710, the control circuitry then being operable to provide an antenna configuration that depends upon the instantaneous curvature. For example, the control circuitry may include circuitry operable to calculate an antenna configuration according to one or more of the approaches described above, taking into account the instantaneous curvature of the flexible antenna. Alternatively, the storage medium may include a look-up table of antenna configurations that is further indexed by antenna curvature, the control circuitry then being operable to read an antenna configuration from the storage medium corresponding to the instantaneous antenna curvature.

The foregoing detailed description has set forth various embodiments of the devices and/or processes via the use of block diagrams, flowcharts, and/or examples. Insofar as such block diagrams, flowcharts, and/or examples contain one or more functions and/or operations, it will be understood by those within the art that each function and/or operation within such block diagrams, flowcharts, or examples can be implemented, individually and/or collectively, by a wide range of hardware, software, firmware, or virtually any combination thereof. In one embodiment, several portions of the subject matter described herein may be implemented via Application Specific Integrated Circuits (ASICs), Field Programmable Gate Arrays (FPGAs), digital signal processors (DSPs), or other integrated formats. However, those skilled in the art will recognize that some aspects of the embodiments disclosed herein, in whole or in part, can be equivalently implemented in integrated circuits, as one or more computer programs running on one or more computers (e.g., as one or more programs running on one or more computer systems), as one or more programs running on one or more processors (e.g., as one or more programs running on one or more microprocessors), as firmware, or as virtually any combination thereof, and that designing the circuitry and/or writing the code for the software and or firmware would be well within the skill of one of skill in the art in light of this disclosure. In addition, those skilled in the art will appreciate that the mechanisms of the subject matter described herein are capable of being distributed as a program product in a variety of forms, and that an illustrative embodiment of the subject matter described herein applies regardless of the particular type of signal bearing medium used to actually carry out the distribution. Examples of a signal bearing medium include, but are not limited to, the following: a recordable type medium such as a floppy disk, a hard disk drive, a Compact Disc (CD), a Digital Video Disk (DVD), a digital tape, a computer memory, etc.; and a transmission type medium such as a digital and/or an analog communication medium (e.g., a fiber optic cable, a waveguide, a wired communications link, a wireless communication link, etc.).

In a general sense, those skilled in the art will recognize that the various aspects described herein which can be implemented, individually and/or collectively, by a wide range of hardware, software, firmware, or any combination thereof can be viewed as being composed of various types of "electrical circuitry." Consequently, as used herein "electrical circuitry" includes, but is not limited to, electrical circuitry having at least one discrete electrical circuit, electrical circuitry having at least one integrated circuit, electrical circuitry having at least one application specific integrated circuit, electrical circuitry forming a general purpose computing device configured by a computer program (e.g., a general purpose computer configured by a computer program which at least partially carries out processes and/or devices described herein, or a microprocessor configured by a computer program which at least partially carries out processes and/or devices described herein), electrical circuitry forming a memory device (e.g., forms of random access memory), and/or electrical circuitry forming a communications device (e.g., a modem, communications switch, or optical-electrical equipment). Those having skill in the art will recognize that the subject matter described herein may be implemented in an analog or digital fashion or some combination thereof.

All of the above U.S. patents, U.S. patent application publications, U.S. patent applications, foreign patents, foreign patent applications and non-patent publications referred to in this specification and/or listed in any Application Data Sheet, are incorporated herein by reference, to the extent not inconsistent herewith.

One skilled in the art will recognize that the herein described components (e.g., steps), devices, and objects and the discussion accompanying them are used as examples for the sake of conceptual clarity and that various configuration modifications are within the skill of those in the art. Consequently, as used herein, the specific exemplars set forth and the accompanying discussion are intended to be representative of their more general classes. In general, use of any specific exemplar herein is also intended to be representative of its class, and the non-inclusion of such specific components (e.g., steps), devices, and objects herein should not be taken as indicating that limitation is desired.

With respect to the use of substantially any plural and/or singular terms herein, those having skill in the art can translate from the plural to the singular and/or from the singular to the plural as is appropriate to the context and/or application. The various singular/plural permutations are not expressly set forth herein for sake of clarity.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein. Furthermore, it is to be understood that the invention is defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

With respect to the appended claims, those skilled in the art will appreciate that recited operations therein may generally be performed in any order. Examples of such alternate orderings may include overlapping, interleaved, interrupted, reordered, incremental, preparatory, supplemental, simultaneous, reverse, or other variant orderings, unless context dictates otherwise. With respect to context, even terms like "responsive to," "related to," or other past-tense adjectives are generally not intended to exclude such variants, unless context dictates otherwise.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. An antenna, comprising:

a waveguide configured to propagate a guided wave along a curved manifold; and a plurality of adjustable subwavelength radiators positioned along the curved manifold and coupled to the waveguide;

wherein the adjustable subwavelength radiators are configured to define a holographic function on the curved manifold;

wherein the guided wave has a propagation direction, and the subwavelength radiators have inter-element spacings along the propagation direction substantially less than a free-space wavelength corresponding to an operating frequency of the antenna; and wherein each of the plurality of subwavelength radiators includes an adjustable surface mount component connected to a surface of the curved circuit board.

2. The antenna of claim 1, wherein the curved manifold corresponds to a curved circuit board that supports the waveguide.

3. The antenna of claim 2, wherein the curved circuit board is a semirigid PCB that has been bent to conform to the curved manifold.

4. The antenna of claim 3, wherein the semirigid PCB is a microwave laminate PCB.

5. The antenna of claim 4, wherein the microwave laminate PCB is a PTFE laminate PCB.

6. The antenna of claim 2, wherein the curved circuit board is a flexible PCB.

7. The antenna of claim 6, wherein the flexible PCB is a polyimide laminate PCB.

8. The antenna of claim 6, wherein the flexible PCB is a liquid crystal polymer laminate PCB.

9. The antenna of claim 2, wherein the waveguide is a substrate-integrated waveguide.

10. The antenna of claim 2, wherein the waveguide is a stripline or microstrip waveguide.

11. The antenna of claim 1, wherein each surface mount component is connected to the surface of the curved circuit board with an elastomeric conductive compound.

12. The antenna of claim 1, wherein each surface mount component is connected to the surface of the curved circuit board with flexible contacts.

13. A method of making a curved antenna, comprising:

identifying a desired curvature for the curved antenna;

obtaining a circuit board that includes a waveguide and a plurality of adjustable subwavelength radiators coupled to the waveguide; and bending the circuit board to conform to the desired curvature;

wherein the adjustable subwavelength radiators are configured to define a holographic function for the desired curvature;

wherein the waveguide has a propagation direction, and the adjustable subwavelength radiators have inter-element spacings along the propagation direction substantially less than a free-space wavelength corresponding to an operating frequency of the antenna; and wherein the obtaining of the circuit board includes, prior to the bending:

selectively applying solder paste to an upper surface of the circuit board; and placing a plurality of adjustable surface mount components on the circuit board to form connections via the selectively applied solder paste, the plurality of adjustable surface mount components corresponding to the plurality of adjustable subwavelength radiators.

14. The method of claim 13, wherein the selectively applying of the solder paste is an applying of the solder paste with a solder screen.

15. The method of claim 13, wherein the placing of the plurality of surface mount components is a placing with a pick-and-place machine.

16. The method of claim 13, wherein the obtained circuit board is a circuit board with unbaked solder paste, and the method further comprises:

after the bending, baking the obtained circuit board in a solder reflow oven.

17. A curved antenna fabricated by a method that includes:

identifying a desired curvature for the curved antenna;

obtaining a circuit board that includes a waveguide and a plurality of adjustable subwavelength radiators coupled to the waveguide; and bending the circuit board to conform to the desired curvature;

wherein the adjustable subwavelength radiators are configured to define a holographic function for the desired curvature;

wherein the waveguide has a propagation direction, and the adjustable subwavelength radiators have inter-element spacings along the propagation direction substantially less than a free-space wavelength corresponding to an operating frequency of the antenna; and wherein the obtaining of the circuit board includes, prior to the bending:

selectively applying solder paste to an upper surface of the circuit board; and placing a plurality of surface mount components on the circuit board to form connections via the selectively applied solder paste, the plurality of surface mount components corresponding to the plurality of adjustable subwavelength radiators.

18. The curved antenna of claim 17, wherein the selectively applying of the solder paste is an applying of the solder paste with a solder screen.

19. The curved antenna of claim 17, wherein the placing of the plurality of surface mount components is a placing with a pick-and-place machine.

20. The curved antenna of claim 17, wherein the obtained circuit board is a circuit board with unbaked solder paste, and the method further comprises:

after the bending, baking the obtained circuit board in a solder reflow oven.

* * * * *